US009260265B2

(12) United States Patent
Deng et al.

(10) Patent No.: US 9,260,265 B2
(45) Date of Patent: Feb. 16, 2016

(54) BANK NOTE STACKING AND SORTING DEVICE AND BANK NOTE STACKING AND SORTING SYSTEM

(71) Applicant: GRG Banking Equipment Co., Ltd., Guangzhou, Guangdong (CN)

(72) Inventors: Xinming Deng, Guangzhou (CN); Zhuang Jiang, Guangzhou (CN)

(73) Assignee: GRG Banking Equipment Co., Ltd., Guangzhou, Guangdong (CN)

( * ) Notice: Subject to any disclaimer, the term of this patent is extended or adjusted under 35 U.S.C. 154(b) by 0 days.

(21) Appl. No.: 14/416,612

(22) PCT Filed: Apr. 9, 2013

(86) PCT No.: PCT/CN2013/073926

§ 371 (c)(1),
(2) Date: Jan. 22, 2015

(87) PCT Pub. No.: WO2014/023107

PCT Pub. Date: Feb. 13, 2014

(65) Prior Publication Data

US 2015/0203318 A1 Jul. 23, 2015

(30) Foreign Application Priority Data

Aug. 7, 2012 (CN) ..... 2012 1 0279637

(51) Int. Cl.

| | |
|---|---|
| ***B65H 29/40*** | (2006.01) |
| ***B65H 31/38*** | (2006.01) |
| ***B65H 31/34*** | (2006.01) |
| ***G07D 13/00*** | (2006.01) |

(52) U.S. Cl.

CPC ..... *B65H 29/40* (2013.01); *B65H 31/34* (2013.01); *B65H 31/38* (2013.01); *G07D 13/00* (2013.01); *B65H 2701/1912* (2013.01)

(58) Field of Classification Search

CPC ..... B65H 29/40; B65H 2701/1912

See application file for complete search history.

(56) References Cited

U.S. PATENT DOCUMENTS 7,770,887 B2 * 8/2010 Park et al. ..... 271/171

FOREIGN PATENT DOCUMENTS

| | | | |
|---|---|---|---|
| CN | 1508056 | A | 6/2004 |
| CN | 1885352 | A | 12/2006 |
| CN | 101097637 | A | 1/2008 |

(Continued)

OTHER PUBLICATIONS

International Search Report dated Jul. 18, 2013 from corresponding International Application No. PCT/CN2013/073926.

*Primary Examiner* — Luis A Gonzalez

(74) *Attorney, Agent, or Firm* — Wolf, Greenfield & Sacks, P.C.

(57) ABSTRACT

A bank note stacking and sorting device, comprising a bank note feeding unit, a bank note stacking unit, and a bank note sorting unit; the bank note feeding unit comprises a bank note guiding table, and a wind wheel sleeved on the bank note guiding table; the bank note stacking unit comprises a bank note stacking rack, and a bank note baffle plate disposed on the bank note stacking rack; the bank note baffle plate is perpendicular to the bottom surface of the bank note stacking rack; the bank note stacking rack is disposed in the bank note feeding direction of the bank note feeding unit for stacking bank notes; the bank note sorting unit comprises a limiting plate; the limiting plate is disposed on the bank note stacking unit, and is perpendicular to the bank note baffle plate.

11 Claims, 6 Drawing Sheets

(56) References Cited

FOREIGN PATENT DOCUMENTS

| | | | |
|---|---|---|---|
| CN | 101100248 | A | 1/2008 |
| CN | 101523447 | A | 9/2009 |
| CN | 102167240 | A | 8/2011 |
| CN | 102275658 | A | 12/2011 |
| CN | 102774683 | A | 11/2012 |
| JP | 6279158 | A | 4/1987 |
| JP | 04350060 | A | 12/1992 |
| JP | 2006302236 | A | 11/2006 |
| JP | 2008084170 | A | 4/2008 |

* cited by examiner

BANK NOTE STACKING AND SORTING DEVICE AND BANK NOTE STACKING AND SORTING SYSTEM

The present application is the national phase of International Application No. PCT/CN2013/073926, filed on Apr. 9, 2013, which claims the benefit of priority to Chinese Patent Application No. 201210279637.X titled "BANKNOTE STACKING AND ARRANGING DEVICE AND SYSTEM" and filed with the State Intellectual Property Office on Aug. 7, 2012, which applications are hereby incorporated by reference to the maximum extent allowable by law.

FIELD OF THE INVENTION

The present application belongs to the field of financial apparatus, and relates to a stacking and arranging device for sheet mediums, and specifically to a banknote stacking and arranging device and a banknote stacking and arranging system.

BACKGROUND OF THE INVENTION

With the development and progress of science and technology, in some occasions that need to handle large amounts of cash, conventional manual procedures, such as sorting and counting, hundred separating, and bundling, have been gradually replaced by various types of advanced automatic processing systems. In the process of handling cashes, it is required to stack and arrange the banknotes.

Referring to FIG. 1 together with FIG. 2, FIG. 1 is a schematic perspective view of a banknote stacking and arranging device in the prior art, and FIG. 2 is a schematic view of conveying wheel shown in FIG. 1 viewing from a sectional direction. The banknote stacking and arranging device includes a banknote conveying unit 10 and a banknote stacking unit 20 arranged behind the banknote conveying unit 10. The banknote conveying unit 10 includes a banknote guide platform 12 and a conveying wheel 14. The upper surface of the banknote guide platform 12 is a banknote guide platform surface 121 with a wavy arc. The conveying wheel 14 is provided on the banknote guide platform 12 at a protruding arc-shaped portion of the banknote guide platform surface 122. The banknote stacking unit 20 includes a fixing frame 22, a banknote stacking shelf 24 and a banknote baffle plate 26. The banknote stacking shelf 24 is fixed on the fixing frame 22 and is of an "L" shape, and is adapted for the stacking of banknotes A thereon. The banknote baffle plate 26 is arranged on the banknote stacking shelf 24 and is located behind the conveying wheel 24 for stopping and holding the banknotes A.

As shown in FIG. 2, when the conveying wheel 14 rotates clockwise along the direction B, vanes of the conveying wheel 14 carry the banknotes from the banknote guide platform surface 121 and rotate together with those banknotes. Due to the action of centrifugal force, the banknotes are thrown towards the banknote stacking shelf 24 while rotating. The banknote baffle plate 26 stops the further backward movement of the banknotes, so that the banknotes are stacked on the banknote stacking shelf 24. However, during rotating at a high speed, due to the flexibility and elasticity of the banknotes themselves, the banknotes not only move backwards, but also move at an upward velocity component. Further, bounce movement of the banknotes may occur after falling on the banknote stacking shelf 24. Hence, the banknotes may obliquely and disorderly lie on the banknote stacking shelf 24, which may affect the next handling operation of arranging and stacking the banknotes.

SUMMARY OF THE INVENTION

In order to overcome the disadvantages or deficiencies in the prior art, an object of the present application is to provide a stacking and arranging device which is capable of stacking the banknotes tidily.

The present application is implemented via the following technical solutions. A banknote stacking and arranging device is provided, including a banknote conveying unit, a banknote stacking unit and a banknote arranging unit. Specifically, the banknote conveying unit includes a banknote guide platform and a conveying wheel provided on the banknote guide platform. The banknote stacking unit includes a banknote stacking shelf and a banknote baffle plate arranged on the banknote stacking shelf. The banknote baffle plate is perpendicular to the bottom face of the banknote stacking shelf, and the banknote stacking shelf is arranged along the direction in which the banknotes are conveyed by the banknote conveying unit such as to facilitate stacking of banknotes. The banknote arranging unit includes a position-limiting plate arranged above the banknote stacking unit and being perpendicular to the banknote baffle plate.

Further, the banknote arranging unit further includes a fixed plate and a locating plate. The fixed plate is fixedly arranged on the banknote stacking unit, and is perpendicular to the bottom face of the banknote stacking shelf. The locating plate is arranged on and parallel to the fixed plate, and is movable up and down along the fixed plate in the direction perpendicular to the bottom face of the banknote stacking shelf. The position-limiting plate is arranged on the locating plate.

Further, the banknote arranging unit further includes a position-limiting rotating shaft, and a locating gear provided on the position-limiting rotating shaft. The locating plate is provided with locating teeth in the direction perpendicular to the bottom face of the banknote stacking shelf. The locating gear is engaged with the locating teeth.

Further, the banknote arranging unit further includes a position-limiting motor. The position-limiting motor drives the position-limiting rotating shaft to rotate.

Further, the banknote arranging unit further includes a top plate arranged at the top of the fixed plate and being perpendicular to the fixed plate.

Further, the position-limiting plate is arranged under the locating plate via a retractable portion.

The present application further provides a stacking and arranging system capable of stacking the banknotes tidily and automatically, which is implemented via the following technical solutions.

A banknote stacking and arranging system is provided, including a controller and a banknote stacking and arranging device, with the controller controlling the operation of the banknote stacking and arranging device. Specifically, the banknote stacking and arranging device includes a banknote conveying unit, a banknote stacking unit, and a banknote arranging unit. Specifically, the banknote conveying unit includes a banknote guide platform and a conveying wheel provided on the banknote guide platform. The banknote stacking unit includes a banknote stacking shelf and a banknote baffle plate arranged on the banknote stacking shelf. The banknote baffle plate is perpendicular to the bottom face of the banknote stacking shelf, and the banknote stacking shelf is arranged along the direction in which the banknotes are conveyed by the banknote conveying unit such as to facilitate stacking of the banknotes. The banknote arranging unit includes a position-limiting plate arranged on the banknote stacking unit and being perpendicular to the banknote baffle plate.

Further, the controller includes a central control module, and an image acquisition module, a data processing module, a storage module and an execution module which are electrically connected to the central control module. The central control module controls the image acquisition module to acquire banknote image information, and to transmit the banknote image information to the data processing module and to store the banknote image information in the storage module. The data processing module invokes a conversion formula stored in the storage module according to the banknote image information to perform data processing, generates a controlling parameter and sends the controlling parameter to the execution module. The execution module generates servo signals for execution elements so as to drive the position-limiting motor to rotate.

Further, the banknote stacking and arranging system also includes a detection module electrically connected to the central control module. The central control module controls the detection module to detect position information of the position-limiting plate, to transmit the position information to the data processing module and to store the position information in the storage module. The data processing module invokes a conversion formula stored in the storage module according to the banknote image information and the position information of the position-limiting plate to perform data processing, generates a controlling parameter and sends the controlling parameter to the execution module. The execution module generates servo signals for the execution elements so as to drive the position-limiting motor to rotate.

As compared with the techniques in the prior art, the banknote stacking and arranging device according to the present application is provided with a banknote arranging unit. The banknotes flying out from the conveying wheel are limited in the vertical direction by the position-limiting plate of the banknote arranging unit, and short edges of the banknotes are tidied, so that the banknotes may be tidily stacked on the banknote stacking shelf, which facilitates the next bundling process of the banknotes.

As compared with the techniques in the prior art, according to the banknote stacking and arranging system in the present application, the controller controls the banknote stacking and arranging device to press the edges of the banknotes and arrange the banknotes automatically and periodically. Different locating and arranging functions can be realized according to different banknote specifications.

In order to better understand the present application more clearly, specific embodiments of the present application will be set forth hereinafter in conjunction with the accompanying drawings.

BRIEF DESCRIPTION OF THE DRAWINGS

FIGS. 8-1, 8-2 and 8-3 are schematic views showing the various steps at which the banknotes are tidied by the banknote stacking and arranging device 100 according to the present application.

DETAILED DESCRIPTION OF THE INVENTION

Figure 3:
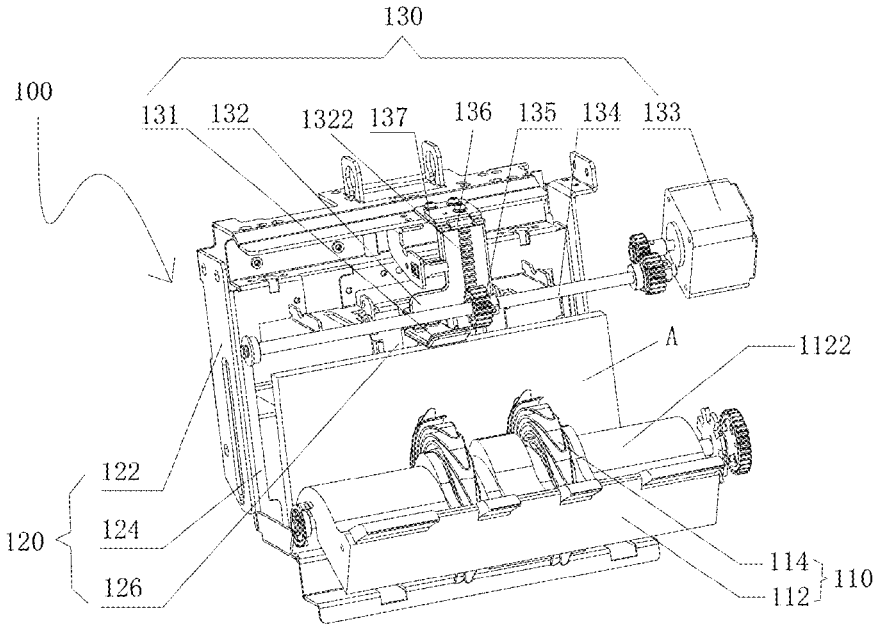
FIG. 3 is a schematic perspective view of a banknote stacking and arranging device according to the present application.

Please refer to FIG. 3, which is a schematic perspective view of a banknote stacking and arranging device according to the present application. The banknote stacking and arranging device 100 includes a banknote conveying unit 110, a banknote stacking unit 120, and a banknote arranging unit 130. The banknote conveying unit 110 conveys the banknotes onto the banknote stacking shelf of the banknote stacking unit 120, and the banknotes being conveyed are stopped and tidied by the banknote arranging unit 130.

Specifically, the banknote conveying unit 110 includes a banknote guide platform 112 and a conveying wheel 114. The upper surface of the banknote guide platform 112 is a banknote guide platform surface 1122 with a wavy arc. The conveying wheel 114 is provided on the banknote guide platform 112 at the protruding arc-shaped portion of the banknote guide platform surface 1122. The conveying wheel 114 includes multiple banknote guide vanes 1142. Banknotes are conveyed onto the banknote guide platform surface 1122 of the banknote guide platform one by one in sequence by a conveying device, and slidingly fall between two banknote guide vanes 1142 of the conveying wheel 114. When the conveying wheel rotates, the banknotes are brought to rotate therewith so as to be conveyed to the banknote stacking unit 120.

The banknote stacking unit 120 includes a fixing frame 122, a banknote stacking shelf 124 and a banknote baffle plate 126. The fixing frame 122 serves for supporting and fixing other parts or components. The banknote stacking shelf 124 is an "L"-shaped frame and is fixed on the fixing frame 122, and is adapted for the stacking and placement of banknotes A thereon. The banknote baffle plate 126 is arranged on the banknote stacking shelf 124 and perpendicular to the bottom part of the banknote stacking shelf 124, and is located behind the conveying wheel 124 such that the banknotes stand against the banknote baffle plate 126. The banknote baffle plate 126 is at an angle of 60 degrees with respect to the horizontal direction.

Figure 4:
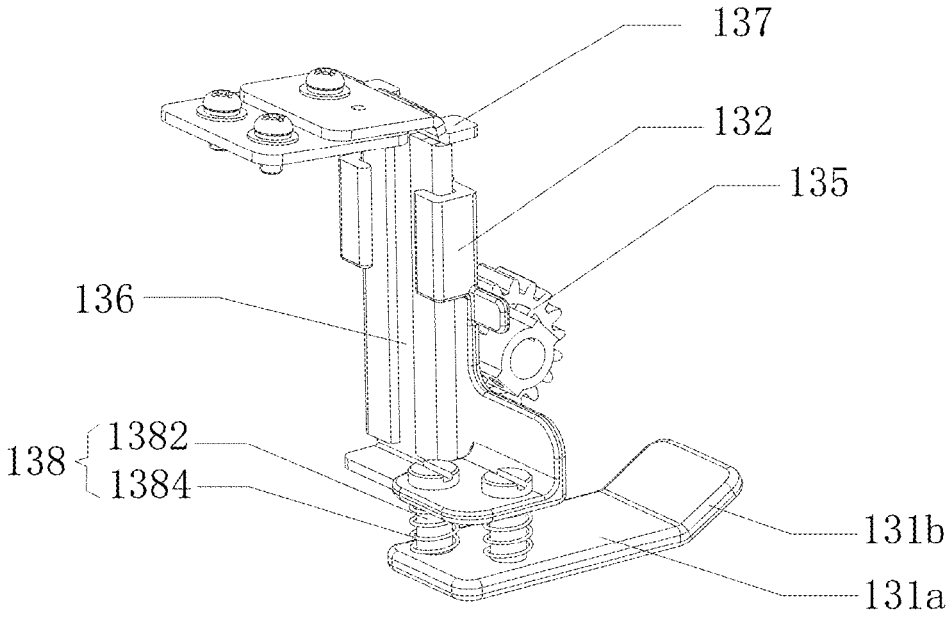
FIG. 4 is a schematic perspective view of a banknote arranging unit of the banknote stacking and arranging device shown in FIG. 3.
Figure 5:
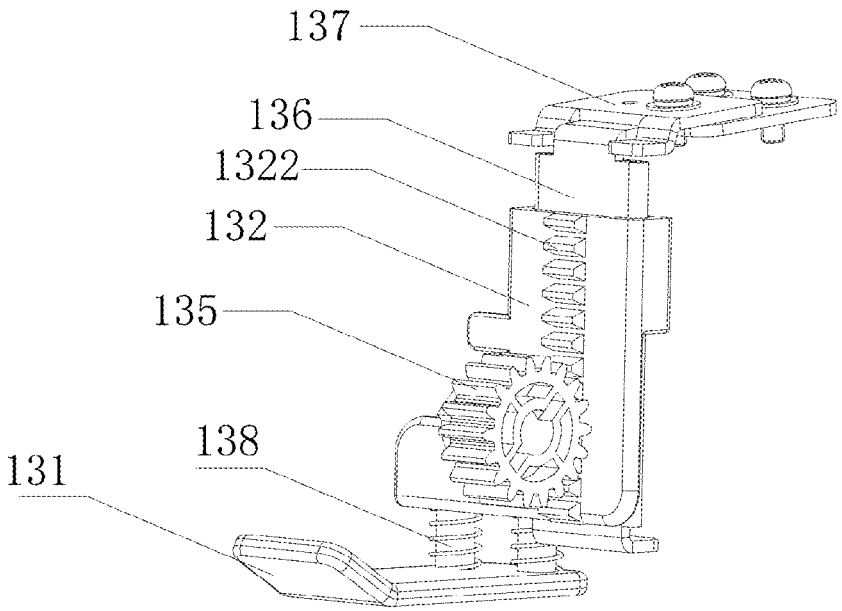
FIG. 5 is another schematic perspective view of the banknote arranging unit of the banknote stacking and arranging device shown in FIG. 3.

Referring to FIG. 4 together with FIG. 5, FIG. 4 is a schematic perspective view of a banknote arranging unit 130 of the banknote stacking and arranging device 100 shown in FIG. 3, and FIG. 5 is another schematic perspective view of the banknote arranging unit 130 of the banknote stacking and arranging device 100 shown in FIG. 3. The banknote arranging unit 130 includes a position-limiting plate 131, a locating plate 132, a position-limiting motor 133, a position-limiting rotating shaft 134, a locating gear 135, a fixed plate 136, a top plate 137 and a retractable portion 138. The fixed plate 136 is fixed on a fixing frame 122 of the banknote stacking unit 120, and is parallel to the banknote baffle plate 126 of the banknote stacking unit 120. The locating plate 132 is arranged on the fixed plate 136 and parallel to the fixed plate 136, and is movable up and down along the fixed plate 136. The locating plate 132 is provided with locating teeth 1322 in the direction perpendicular to the bottom face of the banknote stacking shelf 124. The position-limiting plate 131 is arranged under the locating plate 132 via a retractable portion 138. The position-limiting plate 131 includes a primary baffle plate 131*a* and a secondary baffle plate 131*b* angled with respect to each other. The primary baffle plate 131*a* is perpendicular to the banknote baffle plate 126, and the secondary baffle plate 131*b* tilts upwards slightly. The secondary baffle plate 131*b* and the primary baffle plate 131*a* form an angle of 30 to 45 degrees therebetween, and the secondary baffle plate 131*b* has a length of 10.8 mm. The retractable portion 138 is composed of a guide shaft 1382 and a spring 1384 provided on the guide shaft 1382. The position-limiting plate 131 is flexible to move up and down via the retractable portion 138. The locating gear 135 is provided on the position-limiting rotating shaft 134, and is engaged with the locating teeth 1322 on the locating plate 132. The position-limiting motor 133 drives the position-limiting rotating shaft 134 to rotate, so that the locating gear 135 is rotated, which in turn brings the locating teeth 1322 to move up and down, so as to drive the locating plate 132 to move up and down along the fixed plate 136 and further drive the position-limiting plate 131 to move up and down. The top plate 137 is arranged at the top portion of the fixed plate 136 and is perpendicular to the fixed plate 136. When the locating plate 132 moves up and down along the fixed plate 136, the top plate 137 limits the maximum height of movement of the locating plate 132.

The operation principle of the banknote stacking and arranging device 100 according to the present application will be described in detail hereinafter.

Figure 6:
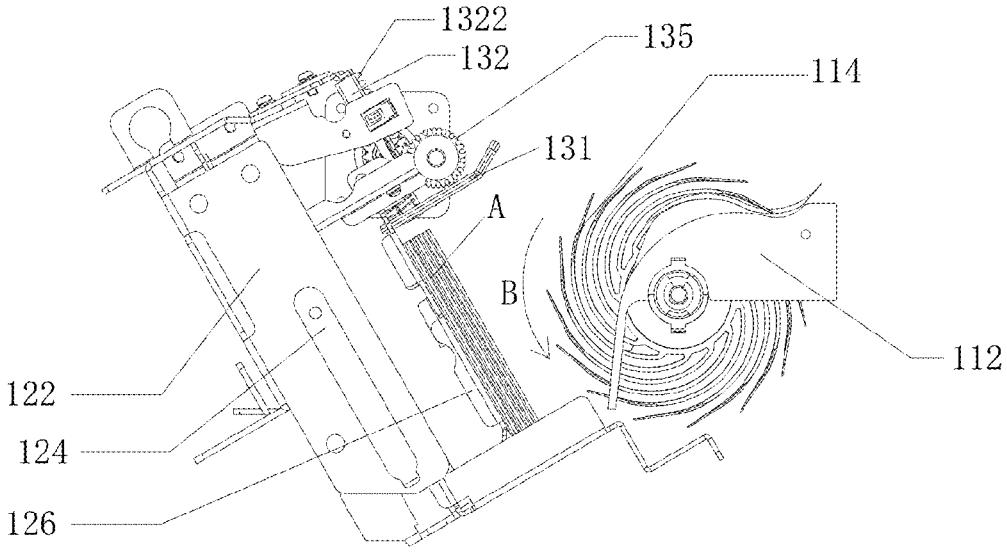
FIG. 6 is a right view of the banknote stacking and arranging device shown in FIG. 3.

Please also refer to FIG. 6, which is a right view of the banknote stacking and arranging device shown in FIG. 3. The banknote conveying device (not shown) conveys the banknotes one by one in sequence onto the banknote guide platform surface 1122 of the banknote guide platform, and the banknotes slidingly fall between two banknote guide vanes 1142 of the conveying wheel 114. When the conveying wheel 14 rotates, vanes of the conveying wheel 14 carry the banknotes on the banknote guide platform surface 1122 and rotate therewith in direction B. Due to the action of centrifugal force, the banknotes are thrown towards the banknote stacking shelf 124 while rotating. Here, the banknotes move both at a first velocity component V1 in the direction perpendicular to the banknote baffle plate 126 and at a second velocity component V2 perpendicular to the first velocity component V1. The movement of the banknotes in the direction of the first velocity component V1 is blocked by the banknote baffle plate 26, and the movement of the banknotes in the direction of the second velocity component V2 is limited and blocked by the position-limiting plate 131, so that the banknotes may rest on the banknote stacking shelf 124 tidily.

The position-limiting motor 133 drives the position-limiting rotating shaft 134 to rotate clockwise or anti-clockwise, and the locating gear 135 provided on the position-limiting rotating shaft 134 rotates along with the position-limiting rotating shaft 134. The locating teeth 1322 engaged with the locating gear 135 move up and down as the locating gear 135 rotates, and further drives the locating plate 132 to move up and down along the fixed plate 136. The position-limiting plate 131 arranged on the locating plate 132 moves as the locating plate 132 moves, so as to set the limit position of the position-limiting plate 131 actually according to different banknote specifications. Further, when a certain number (e.g. 10 pieces) of the banknotes are stacked, the position-limiting motor 133 drives the position-limiting plate 131 to press down the banknotes such that the spring 1384 may be compressed by 2 mm. Therefore, the banknotes are stacked on the banknotes stacking shelf 124 tidily.

Further, the position-limiting plate 131 may also correct the angle of the stacking of the banknotes conveyed from the conveying wheel 114. Please refer to FIGS. 8-1, 8-2 and 8-3, which are schematic views showing the various steps at which the banknotes are tidied by the banknote stacking and arranging device 100 according to the present application. Taking the banknotes having a width of 85 mm as an example, the banknote baffle plate 126 is at an angle of 60 degrees with respect to the horizontal plane; the bottom face of the banknote stacking shelf 124 is perpendicular to the banknote baffle plate 126; and the position-limiting plate 131 has a distance of 88 mm from the bottom face of the banknote stacking shelf 124. The outer diameter of the conveying wheel 114 intersects the terminal end of the banknote guide platform 112 at point "a". The point "a" is also the starting point from which the banknotes just exit the conveying wheel 114, and has a distance of 4.4 mm from the bottom face of the banknote stacking shelf 124. The straight line "ac" is perpendicular to the primary baffle plate 131*a* of the position-limiting plate 131, and point "c" is located on the primary baffle plate 131*a*. The length of a straight line "ab" is equal to the width of the banknotes of 85 mm, and point "b" is located on the secondary baffle plate 131*b* of the position-limiting plate 131, and the distance between the point "b" and the point "c" is 2.4 mm. The angle between the primary baffle plate 131*a* and the secondary baffle plate 131*b* of the position-limiting plate 131 is set to be 30 degrees, and the secondary baffle plate 131*b* has a length of 10.8 mm. The secondary baffle plate 131*b* guides the banknotes downwards onto banknote stacking shelf 124, so as to avoid the banknotes to be caught.

Figure 1:
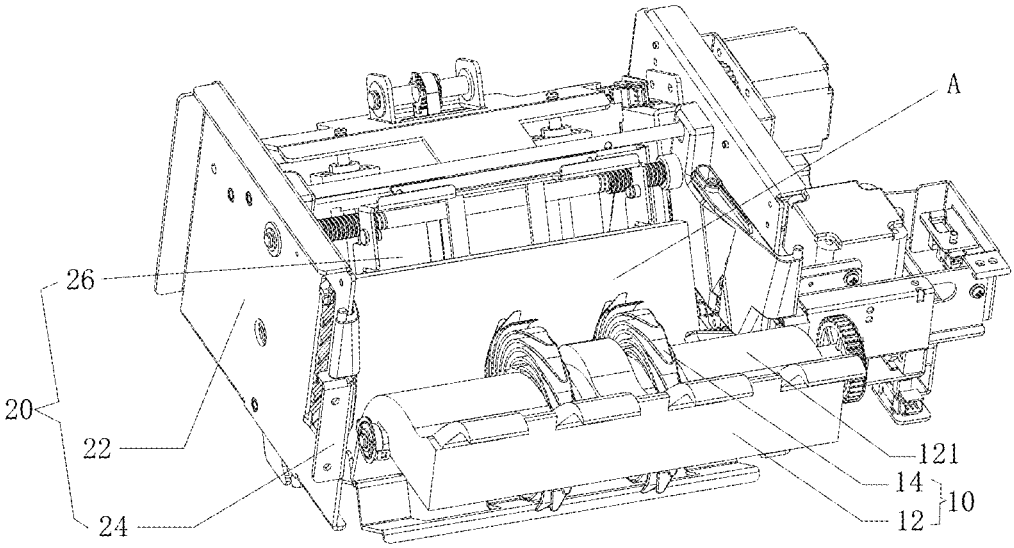
FIG. 1 is a schematic perspective view of a banknote stacking and arranging device in the prior art.
Figure 2:
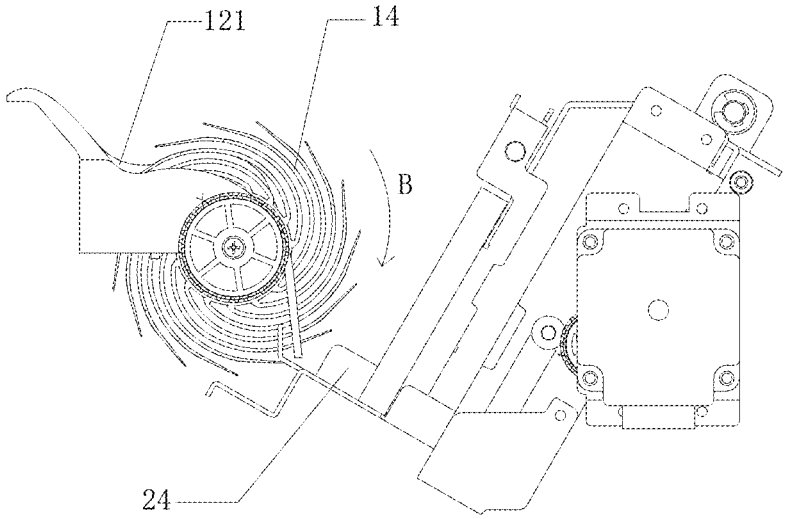
FIG. 2 is a right view of the banknote stacking and arranging device shown in FIG. 1.
Figures 1, 8:
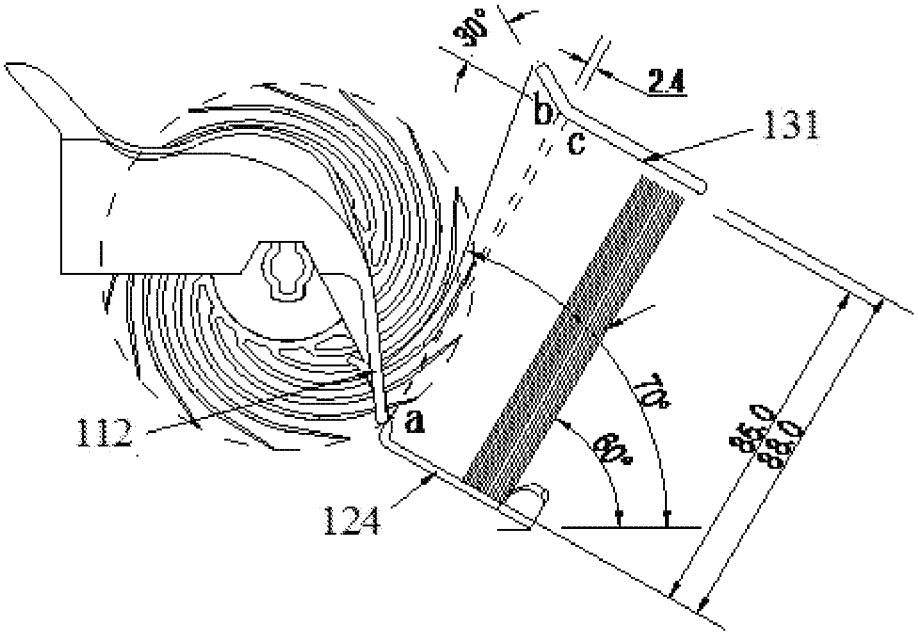
Figures 2, 8:
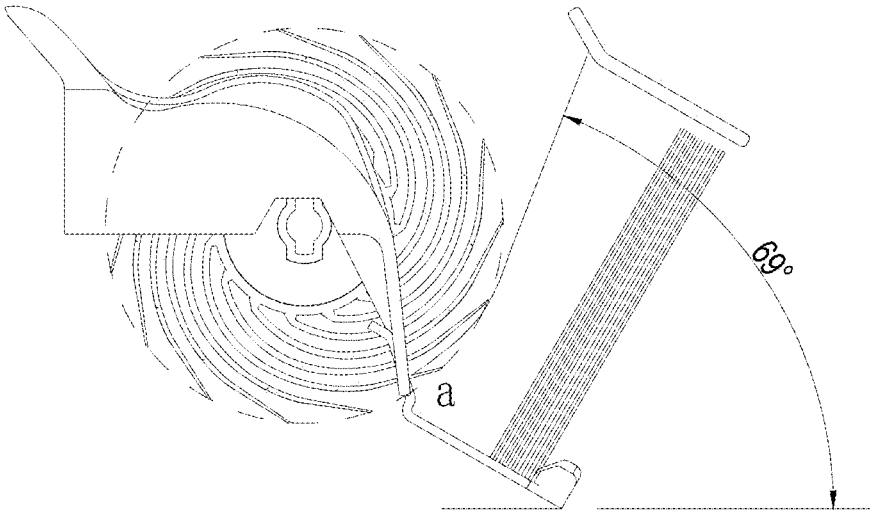
Figures 3, 8:
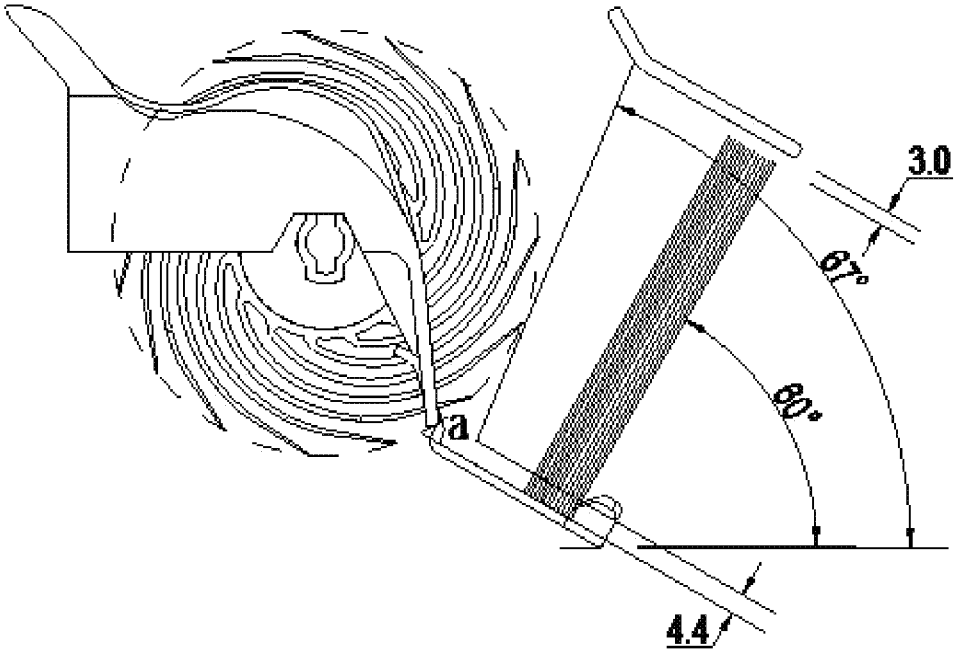

In FIG. 8-1, when the conveying wheel 114 rotates clockwise, and the banknote rotates along with the conveying wheel 114, one end of the banknote is firstly stopped by the end of the secondary baffle plate 131*b* of the position-limiting plate 131. At this time, the banknote is at an angle of 70 degrees with respect to the horizontal plane. The conveying wheel 114 keeps on rotating clockwise, and the end of the banknote slides downwards along the secondary baffle plate 131*b* of the position-limiting plate 131. In FIG. 8-2, the end of the banknote located on the conveying wheel 114 rotates to point "a" so as to just exit the conveying wheel 114. Since the point "a" has a distance of 4.4 mm from the bottom face of the banknote stacking shelf 124, the distance "ac" between the point "a" and the primary baffle plate 131*a* of the position-limiting plate 131 is 83.6 mm, which is less than the width of the banknote of 85 mm. Thus, when the end of the banknote on the conveying wheel 114 rotates to point "a", the other end of the banknote still abuts against the secondary baffle plate 131*b* of the position-limiting plate 131. At this moment, the banknote is at an angle of 69 degrees with respect to the horizontal plane. As the conveying wheel 114 keeps on rotating clockwise, the end of the banknote located on the conveying wheel 114 completely move away from the conveying wheel 114, and the other end of the banknote continues to slide downwards along the secondary baffle plate 131*b* of the position-limiting plate 131. In FIG. 8-3, the banknote is at an angle of 67 degrees with respect to the horizontal plane.

Because of the angle between the banknote and the horizontal plane less than 90 degrees, as well as the gravity of the banknote itself and the pushing force generated from the movement of the next banknote, the banknote finally is stacked on the banknote stacking shelf 124 at an angle of 60 degrees with respect to the horizontal plane, and leans plainly against the banknote baffle plate 126.

Compared with the techniques in the prior art, the banknote stacking and arranging device according to the present application is provided with a banknote arranging unit. The banknotes flying out from the conveying wheel are limited in position in the vertical direction via the position-limiting plate of the banknote arranging unit, and the movement angle of the banknote is corrected by the secondary baffle plate of the position-limiting plate. Besides, short edges of the banknotes may be tidied further, so that the banknotes may be tidily stacked on the banknote stacking shelf, which facilitate the next process of bundling the banknotes.

Figure 7:
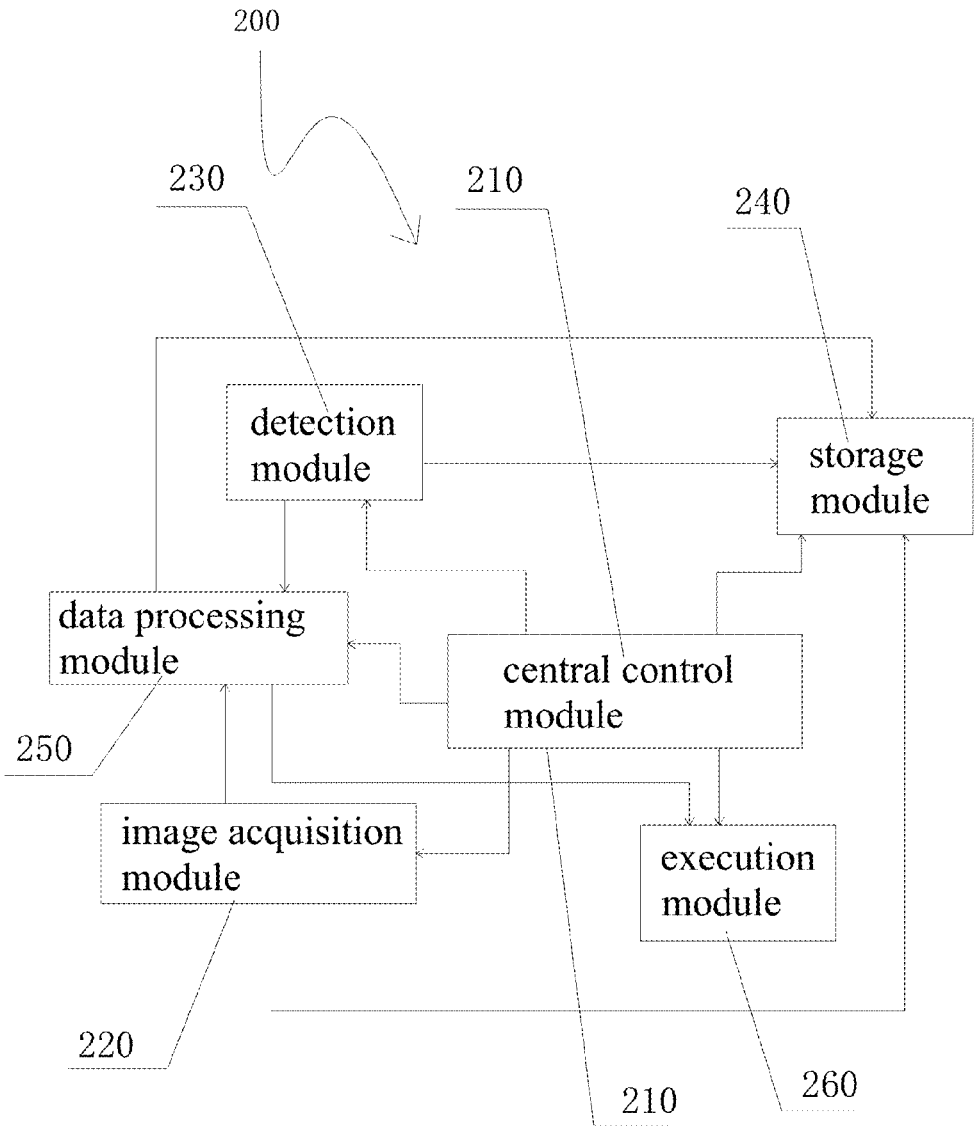
FIG. 7 is a structural block diagram of a controller of a banknote stacking and arranging system according to the present application.

Further, in order to achieve the automatic detection and control functions of the banknote stacking and arranging device, the present application further provides a banknote stacking and arranging system. The banknote stacking and arranging system 300 includes a controller 200 and a banknote stacking and arranging device 100. Please refer to FIG. 7, which is a structural block diagram of a controller 200 of a banknote stacking and arranging system according to the present application. The controller 200 includes a central control module 210, an image acquisition module 220, a detection module 230, a storage module 240, a data processing module 250, and an execution module 260.

The central control module 210 is connected to the image acquisition module 220, the detection module 230, the storage module 240, the data processing module 250, and the execution module 260, so as to call and control the above modules and enable those modules to operate with each other harmoniously.

The image acquisition module 220 includes a photoelectric sensor arranged on the banknote conveying unit 110 to acquire the image information of the banknotes and to store the information in the storage module 240.

The detection module 230 includes a position sensor and a counting sensor. The position sensor is arranged on the fixed plate 136 of the banknote arranging unit 130 to detect the position of the position-limiting plate 131 or the locating tooth 1322 and to store the detected information in the storage module 240. The counting sensor is arranged on the banknote stacking shelf 124 or the banknote guide platform 112 to count the number of the banknotes.

The storage module 240 stores image information of the banknotes, physical property information of the banknotes (including the width value of banknotes), the width value of the initial position of the position-limiting plate 131, a conversion formula for width adjustment, a conversion formula for converting the width adjustment value into the amount of movement of elements, or the like.

According to the image information acquired by the image acquisition module 220, the initial position of the position-limiting plate 131 detected by the detection module 230, and the number of the stacked banknotes detected by the counting sensor, the data processing module 250 invokes a conversion formula for adjusting the corresponding width and a conversion formula for the conversion amount of movement of the elements stored in the storage module 240 to perform data processing, so as to achieve a position parameter for adjusting the position-limiting plate 131 or the locating tooth 1322 and a drive parameter for driving the position-limiting motor 133.

The execution module 260 generates servo signal for the execution elements according to the drive parameter of the data processing module 250, so as to drive the position-limiting motor 133 of the banknote stacking and arranging device 100 to rotate, and further adjust the current position of the position-limiting plate 131.

The operation process of the banknote stacking and arranging system 300 is described in detail hereinafter.

1) When the conveying wheel 114 rotates, the central control module 210 controls the photoelectric sensor of the image acquisition module 220 to acquire the image information of the banknotes and to transmit the information to the data processing module 250 and to store the information in the storage module 240.

2) Meanwhile, the central control module 210 controls the position sensor of the detection module 230 to detect the current initial position of the position-limiting plate 131, and to transmit the data to the data processing module 250, and to store the data in the storage module 240.

3) The central control module 210 controls the data processing module 250 to invoke the conversion formulas stored in the storage module 240 for adjusting the width and for converting the amount of movement of the elements according to the current banknote image information and the current initial position of the position-limiting plate 131 to perform data processing, so as to generate a position parameter for adjusting the position-limiting plate 131 or the locating tooth 1322 and a drive parameter for driving the position-limiting motor 133.

4) The central control module 210 controls the execution module to generate servo signal for the execution elements according to the drive parameter from the data processing module 250, so as to drive the position-limiting motor 133 to rotate, and further adjust the upward or downward movement of the position-limiting plate 131.

Taking the banknotes having a width of 85 mm as an example, the controller 200 controls the position-limiting motor 133 to rotate, so as to drive the position-limiting plate 131 to move such as to be 88 mm apart from the bottom face of the banknote stacking shelf 124.

5) Central control module 210 also controls the counting sensor of the detection module 230 to monitor the number of the banknotes on the banknote stacking shelf 124. When a certain number of banknotes have been stacked, for example 10 pieces, the central control module 210 controls the execution module 260 to drive the position-limiting motor 133 to rotate. As such, the position-limiting plate 131 is driven to press the banknotes downwards until causing an interference of 2 mm with respect to the banknotes, and then returns, thereby arranging the short edges of the banknotes.

6) The central control module 210 also controls the counting sensor of the detection module 230 to monitor the number of the banknotes on the banknote stacking shelf 124. When a certain number of banknotes have been stacked, for example 100 pieces, the central control module 210 controls the execution module 260 to drive the position-limiting motor 133 to rotate. As such, the position-limiting plate 131 is driven to press the banknotes downwards until causing an interference of 2 mm with respect to the banknotes, and then returns. Then, the banknote stacking shelf 124 is further driven to bring the whole stack of the banknotes to move downwards, and to send the banknotes to a clamping mechanism (not shown) which sends the banknotes to a bundling mechanism for being bundled.

As compared with the techniques in the prior art, according to the banknote stacking and arranging system in the present application, the controller controls the banknote stacking and arranging device to press the edges of the banknotes and arrange the banknotes automatically and periodically. Different locating and arranging functions may be implemented according to different banknote specifications. The stacking and arranging system and the stacking and arranging device according to the present application are applicable for stacking and arranging other sheet mediums in addition to banknotes.

The present application is not limited to the above embodiments. If various variations or modifications to the present application do not depart from the spirit and scope of the present application, and if these variations and modifications fall within the scope of the claims and equivalent techniques of the present application, it is intended that the present application includes those variations and modifications.

The invention claimed is:

1. A banknote stacking and arranging device, comprising:

a banknote conveying unit comprising a banknote guide platform and a conveying wheel provided on the banknote guide platform;

a banknote stacking unit comprising a banknote stacking shelf and a banknote baffle plate arranged on the banknote stacking shelf, with the banknote baffle plate being perpendicular to a bottom face of the banknote stacking shelf, and the banknote stacking shelf being arranged along a direction in which banknotes are conveyed by the banknote conveying unit such as to facilitate stacking of the banknotes thereon; and a banknote arranging unit comprising a position-limiting plate which is arranged above the banknote stacking unit and is perpendicular to the banknote baffle plate;

wherein the banknote arranging unit further comprises a fixed plate and a locating plate, the fixed plate is fixedly arranged on the banknote stacking unit and is perpendicular to the bottom face of the banknote stacking shelf, the locating plate is arranged on and parallel to the fixed plate and is movable up and down along the fixed plate in a direction perpendicular to the bottom face of the banknote stacking shelf, and the position-limiting plate is arranged on the locating plate.

2. The banknote stacking and arranging device according to claim 1, wherein the position-limiting plate is arranged under the locating plate via a retractable portion.

3. The banknote stacking and arranging device according to claim 2, wherein the position-limiting plate comprises a primary baffle plate and a secondary baffle plate angled by 30 to 45 degrees with respect to each other, the primary baffle plate is perpendicular to the banknote baffle plate.

4. A banknote stacking and arranging system, comprising a controller and the banknote stacking and arranging device according to claim 3, wherein the controller controls operation of the banknote stacking and arranging device.

5. The banknote stacking and arranging system according to claim 4, wherein the controller comprises a central control module, and an image acquisition module, a data processing module, a storage module and an execution module which are electrically connected to the central control module; and wherein the central control module controls the image acquisition module to acquire banknote image information and to transmit the banknote image information to the data processing module and to store the banknote image information in the storage module; and wherein the data processing module invokes a conversion formula stored in the storage module according to the banknote image information to perform data processing, generates a controlling parameter and sends the controlling parameter to the execution module; and wherein the execution module generates servo signals for execution elements so as to drive the position-limiting motor to rotate.

6. The banknote stacking and arranging system according to claim 5, further comprising a detection module electrically connected to the central control module, wherein the central control module controls the detection module to detect position information of the position-limiting plate and to transmit the position information to the data processing module and to store the position information in the storage module; and wherein the data processing module invokes a conversion formula stored in the storage module according to the banknote image information and the position information of the position-limiting plate to perform data processing, generates a controlling parameter and sends the controlling parameter to the execution module; and wherein the execution module generates servo signals for the execution elements so as to drive the position-limiting motor to rotate.

7. The banknote stacking and arranging system according to claim 6, wherein the image acquisition module comprises a photoelectric sensor arranged on the banknote conveying unit.

8. The banknote stacking and arranging system according to claim 6, wherein the detection module comprises a position sensor arranged on the fixed plate of the banknote arranging unit.

9. The banknote stacking and arranging system according to claim 8, wherein the detection module further comprises a counting sensor arranged on the banknote stacking shelf or the banknote guide platform.

10. The banknote stacking and arranging system according to claim 7, wherein the detection module comprises a position sensor arranged on the fixed plate of the banknote arranging unit.

11. The banknote stacking and arranging system according to claim 10, wherein the detection module further comprises a counting sensor arranged on the banknote stacking shelf or the banknote guide platform.

* * * * *